US011160148B2

(12) United States Patent
Hussell

(10) Patent No.: US 11,160,148 B2
(45) Date of Patent: Oct. 26, 2021

(54) ADAPTIVE AREA LAMP

(71) Applicant: IDEAL Industries Lighting LLC, Racine, WI (US)

(72) Inventor: Christopher P. Hussell, Cary, NC (US)

(73) Assignee: IDEAL Industries Lighting LLC, Racine, WI (US)

( * ) Notice: Subject to any disclaimer, the term of this patent is extended or adjusted under 35 U.S.C. 154(b) by 0 days.

(21) Appl. No.: 15/621,731

(22) Filed: Jun. 13, 2017

(65) Prior Publication Data

US 2018/0359825 A1 Dec. 13, 2018

(51) Int. Cl.
*H05B 45/10* (2020.01)
*H05B 45/12* (2020.01)

(52) U.S. Cl.
CPC ..... *H05B 45/10* (2020.01); *H05B 45/12* (2020.01)

(58) Field of Classification Search
CPC ..... H05B 45/37; H05B 45/10; H05B 45/12
See application file for complete search history.

(56) References Cited

U.S. PATENT DOCUMENTS 4,319,070 A * 3/1982 Imai ..... H01B 9/001 174/15.7
5,955,747 A 9/1999 Ogihara et al.
6,160,354 A * 12/2000 Ruvinskiy ..... G09G 3/14 315/169.2
6,657,236 B1 12/2003 Thibeault et al.
6,747,298 B2 6/2004 Slater, Jr. et al.
6,791,119 B2 9/2004 Slater, Jr. et al.
6,821,804 B2 11/2004 Thibeault et al.
6,888,167 B2 5/2005 Slater, Jr. et al.
7,211,803 B1 5/2007 Dhurjaty et al.
7,829,906 B2 11/2010 Donofrio
8,716,724 B2 5/2014 von Malm et al.
8,835,959 B2 9/2014 Nakamura et al.
(Continued)

FOREIGN PATENT DOCUMENTS

CN 101894851 A 11/2010
EP 2197051 A2 6/2010
(Continued)

OTHER PUBLICATIONS

Non-Final Office Action for U.S. Appl. No. 15/399,729, dated Jan. 24, 2018, 12 pages.
(Continued)

*Primary Examiner* — Evan P Dzierzynski
(74) *Attorney, Agent, or Firm* — Withrow & Terranova, PLLC

(57) ABSTRACT

An area lamp includes an emitter array and driver circuitry. The emitter array includes a number of solid-state light emitters. Each one of the solid-state light emitters is configured to provide light suitable for general illumination within a field of view such that light emitted from a first subset of the number of solid-state light emitters is provided to a different portion of the field of view than light emitted from a second subset of the number of solid-state light emitters. The driver circuitry is coupled to the emitter array and configured to provide drive signals to the emitter array such that the light provided from each one of the solid-state light emitters is independently controllable and a number of drive signals is less than the number of solid-state light emitters.

26 Claims, 14 Drawing Sheets

(56) References Cited

U.S. PATENT DOCUMENTS

| | | | | |
|---|---|---|---|---|
| 8,940,561 | B2 | 1/2015 | Donofrio et al. | |
| 8,963,121 | B2 | 2/2015 | Odnoblyudov et al. | |
| 8,969,897 | B2 | 3/2015 | Choi | |
| 8,981,395 | B2 | 3/2015 | Choi et al. | |
| 9,048,368 | B2 | 6/2015 | Jeong | |
| 9,099,575 | B2 | 8/2015 | Medendorp, Jr. et al. | |
| 9,123,864 | B2 | 9/2015 | Tomonari et al. | |
| 9,129,977 | B2 | 9/2015 | Marchand et al. | |
| 9,130,127 | B2 | 9/2015 | Katsuno et al. | |
| 9,130,128 | B2 | 9/2015 | Shinohara | |
| 9,130,137 | B2 | 9/2015 | Lin et al. | |
| 9,136,432 | B2 | 9/2015 | Yun et al. | |
| 9,136,433 | B2 | 9/2015 | Park et al. | |
| 9,142,725 | B1 | 9/2015 | Suzuki | |
| 9,153,750 | B2 | 10/2015 | Seo et al. | |
| 9,159,894 | B2 | 10/2015 | Cho et al. | |
| 9,166,107 | B2 | 10/2015 | Park | |
| 9,166,108 | B2 | 10/2015 | Unosawa | |
| 9,166,110 | B2 | 10/2015 | Aihara | |
| 9,166,111 | B2 | 10/2015 | Matsui et al. | |
| 9,171,882 | B2 | 10/2015 | Akimoto et al. | |
| 9,172,002 | B2 | 10/2015 | Wang et al. | |
| 9,172,021 | B2 | 10/2015 | Sugizaki et al. | |
| 9,178,121 | B2 | 11/2015 | Edmond et al. | |
| 9,196,653 | B2 | 11/2015 | Leatherdale et al. | |
| 9,209,223 | B2 | 12/2015 | Lee et al. | |
| 9,219,196 | B2 | 12/2015 | Seo et al. | |
| 9,219,200 | B2 | 12/2015 | Erchak et al. | |
| 9,231,037 | B2 | 1/2016 | Shimayama | |
| 9,236,526 | B2 | 1/2016 | Choi et al. | |
| 9,240,433 | B2 | 1/2016 | Kim et al. | |
| 9,252,345 | B2 | 2/2016 | Cho et al. | |
| 9,263,643 | B2 | 2/2016 | Huang et al. | |
| 9,263,652 | B2 | 2/2016 | Yoon et al. | |
| 9,269,858 | B2 | 2/2016 | Schubert et al. | |
| 9,277,618 | B2 | 3/2016 | Odnoblyudov et al. | |
| 9,281,448 | B2 | 3/2016 | Choi et al. | |
| 9,281,449 | B2 | 3/2016 | Kim et al. | |
| 9,287,457 | B2 | 3/2016 | Jeong et al. | |
| 9,293,664 | B2 | 3/2016 | Seo et al. | |
| 9,293,674 | B2 | 3/2016 | Kususe et al. | |
| 9,293,675 | B2 | 3/2016 | Yang et al. | |
| 9,299,889 | B2 | 3/2016 | Katsuno et al. | |
| 9,299,893 | B2 | 3/2016 | Chen et al. | |
| 9,300,111 | B2 | 3/2016 | Lee et al. | |
| 9,318,529 | B2 | 4/2016 | Jang et al. | |
| 9,324,765 | B2 | 4/2016 | An | |
| 9,337,175 | B2 | 5/2016 | Seo et al. | |
| 9,362,335 | B2 | 6/2016 | von Malm | |
| 9,373,756 | B2 | 6/2016 | Lee et al. | |
| 9,653,643 | B2 | 5/2017 | Bergmann et al. | |
| 9,729,676 | B2 | 8/2017 | Kobayashi et al. | |
| 9,754,926 | B2 | 9/2017 | Donofrio et al. | |
| 9,831,220 | B2 | 11/2017 | Donofrio et al. | |
| 10,317,787 | B2 | 6/2019 | Graves et al. | |
| 2003/0015959 | A1 | 1/2003 | Tomoda et al. | |
| 2005/0023550 | A1 | 2/2005 | Eliashevich et al. | |
| 2005/0253492 | A1 | 11/2005 | Besshi et al. | |
| 2006/0012588 | A1* | 1/2006 | Shinohara | G09G 3/005 345/204 |
| 2006/0281203 | A1 | 12/2006 | Epler et al. | |
| 2007/0001943 | A1* | 1/2007 | Lee | G09G 3/2014 345/83 |
| 2008/0179611 | A1 | 7/2008 | Chitnis et al. | |
| 2008/0211416 | A1 | 9/2008 | Negley et al. | |
| 2008/0290351 | A1 | 11/2008 | Ajiki et al. | |
| 2009/0179843 | A1* | 7/2009 | Ackermann | G09G 3/3208 345/89 |
| 2009/0241390 | A1 | 10/2009 | Roberts | |
| 2010/0015574 | A1 | 1/2010 | Van der Zel et al. | |
| 2010/0051785 | A1 | 3/2010 | Dai et al. | |
| 2010/0123386 | A1 | 5/2010 | Chen | |
| 2010/0163900 | A1 | 7/2010 | Seo et al. | |
| 2010/0318636 | A1 | 12/2010 | Matsumura et al. | |
| 2011/0049545 | A1 | 3/2011 | Basin et al. | |
| 2011/0084294 | A1 | 4/2011 | Yao | |
| 2011/0121732 | A1 | 5/2011 | Tsutsumi | |
| 2011/0291143 | A1 | 12/2011 | Kim et al. | |
| 2011/0294240 | A1 | 12/2011 | Kim | |
| 2011/0297979 | A1 | 12/2011 | Diana et al. | |
| 2012/0062135 | A1* | 3/2012 | Tamaki | G09G 3/364 315/210 |
| 2012/0119237 | A1 | 5/2012 | Leatherdale et al. | |
| 2012/0205634 | A1 | 8/2012 | Ikeda et al. | |
| 2012/0236582 | A1 | 9/2012 | Waragaya et al. | |
| 2012/0268042 | A1 | 10/2012 | Shiobara et al. | |
| 2013/0264592 | A1 | 10/2013 | Bergmann et al. | |
| 2014/0070245 | A1 | 3/2014 | Haberern et al. | |
| 2014/0110730 | A1 | 4/2014 | Lee et al. | |
| 2014/0361321 | A1 | 12/2014 | Saito et al. | |
| 2015/0049502 | A1 | 2/2015 | Brandt et al. | |
| 2015/0207045 | A1 | 7/2015 | Wada et al. | |
| 2015/0228876 | A1 | 8/2015 | Place et al. | |
| 2015/0279902 | A1 | 10/2015 | Von Malm et al. | |
| 2015/0295009 | A1 | 10/2015 | Wang et al. | |
| 2015/0311407 | A1* | 10/2015 | Gootz | H01L 27/15 257/89 |
| 2015/0340346 | A1 | 11/2015 | Chu et al. | |
| 2016/0150614 | A1 | 5/2016 | Randolph | |
| 2016/0163916 | A1 | 6/2016 | Ilievski et al. | |
| 2016/0240516 | A1 | 8/2016 | Chang | |
| 2017/0092820 | A1 | 3/2017 | Kim et al. | |
| 2017/0098746 | A1 | 4/2017 | Bergmann et al. | |
| 2017/0135177 | A1* | 5/2017 | Wang | H05B 37/0227 |
| 2017/0141280 | A1 | 5/2017 | Zhong et al. | |
| 2017/0148771 | A1 | 5/2017 | Cha et al. | |
| 2017/0207284 | A1 | 7/2017 | Dykaar | |
| 2017/0250164 | A1 | 8/2017 | Takeya et al. | |
| 2017/0287887 | A1 | 10/2017 | Takeya et al. | |
| 2017/0294417 | A1 | 10/2017 | Edmond et al. | |
| 2017/0294418 | A1 | 10/2017 | Edmond et al. | |
| 2017/0317251 | A1 | 11/2017 | Sweegers et al. | |
| 2017/0358624 | A1 | 12/2017 | Takeya et al. | |
| 2018/0012949 | A1 | 1/2018 | Takeya et al. | |
| 2018/0076368 | A1 | 3/2018 | Russell | |
| 2018/0145058 | A1 | 5/2018 | Meitl et al. | |
| 2018/0212108 | A1 | 7/2018 | Leirer et al. | |
| 2019/0044040 | A1 | 2/2019 | Andrews | |

FOREIGN PATENT DOCUMENTS

| | | | |
|---|---|---|---|
| EP | 2320483 | A1 | 5/2011 |
| EP | 2325883 | A2 | 5/2011 |
| EP | 2393132 | A2 | 12/2011 |
| EP | 3076442 | A1 | 10/2016 |
| JP | 2008262993 | A | 10/2008 |
| JP | 2010087292 | A | 4/2010 |
| JP | 2013106048 | A | 5/2013 |
| JP | 2013179197 | A | 9/2013 |
| JP | 5788046 | B2 | 9/2015 |
| JP | 2019016821 | A | 1/2019 |
| KR | 1020130086109 | A | 7/2013 |
| WO | 2008062783 | A1 | 5/2008 |
| WO | 2015063077 | A1 | 5/2015 |
| WO | 2015135839 | A1 | 9/2015 |
| WO | 2016188505 | A1 | 12/2016 |

OTHER PUBLICATIONS

Author Unknown, "MBI5026: 16-bit Constant Current LED Sink Driver," Datasheet, Version 1.0, Mar. 2004, Hsinchu, Taiwan, www.DatasheetCatalog.com, Macroblock, Inc., pp. 1-15.

Carey, Julian, "New LED architectures and phosphor technologies lower costs and boost quality (Magazine)," LEDs Magazine, accessed Feb. 17, 2017, http://www.ledsmagazine.com/articles/print/volume-11/issue-7/features/manufacturing/new-led-architectures-and-phosphor-technologies-lower-costs-and-boost-quality.html, published Sep. 4, 2014, PennWell Corporation, 7 pages.

Chong, Wing et al., "1700 pixels per inch (PPI) Passive-Matrix Micro-LED Display Powered by ASIC," IEEE Compound Semiconductor Integrated Circuit Symposium (CSICs), Oct. 19-22, 2014, IEEE, 4 pages.

(56) References Cited

OTHER PUBLICATIONS

Dodel, Dr. Kerstin et al., "Capital Markets Day 2015," HELLA KGaA Hueck & Co, Dec. 2, 2015, London, HELLA, pp. 1-89.
Herrnsdorf, Johannes et al., "Active-Matrix GaN Micro Light-Emitting Diode Display With Unprecedented Brightness," IEEE Transactions on Electron Devices, vol. 62, Issue 6, Jun. 2015, IEEE, pp. 1918-1925.
Jiang, H. X. et al., "Nitride micro-LEDs and beyond—a decade progress review," Optics Express, vol. 21, Issue S3, Apr. 22, 2013, OSA, 10 pages.
Non-Final Office Action for U.S. Appl. No. 15/401,240, dated May 26, 2017, 7 pages.
Non-Final Office Action for U.S. Appl. No. 15/401,240, dated Jan. 17, 2018, 8 pages.
Invitation to Pay Additional Fees and Partial Search Report for International Patent Application No. PCT/US2017/026163, dated Aug. 1, 2017, 23 pages.
International Search Report and Written Opinion for International Patent Application No. PCT/US2017/026163, dated Oct. 25, 2017, 30 pages.
Final Office Action for U.S. Appl. No. 15/399,729, dated Jun. 28, 2018, 9 pages.
Final Office Action for U.S. Appl. No. 15/401,240, dated Jun. 26, 2018, 11 pages.
Official Letter for Taiwanese Patent Application No. 106112033, dated Aug. 27, 2018, 19 pages.
Notice of Allowance for U.S. Appl. No. 15/399,729, dated Oct. 23, 2018, 8 pages.
Notice of Allowance for U.S. Patent Application No. 15/401,240, dated Oct. 25, 2018, 7 pages.
International Preliminary Report on Patentability for International Patent Application No. PCT/US2017/026163, dated Oct. 25, 2018, 20 pages.
Final Office Action for U.S. Appl. No. 16/414,162, dated Jul. 15, 2020, 11 pages.
Notice of Allowance for U.S. Appl. No. 16/414,162, dated Sep. 23, 2020, 8 pages.
Notice of Allowance for U.S. Appl. No. 16/229,986, dated Sep. 24, 2020, 8 pages.
Notice of Reasons for Refusal for Japanese Patent Application No. 2018-553935, dated Nov. 24, 2020, 6 pages.
Office Action for Korean Patent Application No. 10-2018-7032540, dated Oct. 21, 2020, 23 pages.
Notice of Allowance for U.S. Appl. No. 17/008,544, dated Sep. 29, 2020, 8 pages.
Non-Final Office Action for U.S. Appl. No. 16/414,162, dated Sep. 13, 2019, 11 pages.
Notice of Allowance for U.S. Appl. No. 16/053,980, dated Oct. 21, 2019, 9 pages.
Non-Final Office Action for U.S. Appl. No. 16/174,584, dated Oct. 21, 2019, 7 pages.
Notice of Allowance for U.S. Appl. No. 16/174,584, dated Mar. 23, 2020, 11 pages.
Quayle Action for U.S. Appl. No. 16/229,986, mailed May 29, 2020, 6 pages.
Invitation to Pay Additional Fees and Partial Search Report for International Patent Application No. PCT/US2018/045102, dated Oct. 30, 2018, 14 pages.
Examination Report for European Patent Application No. 17721889.8, dated Apr. 26, 2019, 12 pages.
Notice of Allowance for U.S. Appl. No. 15/896,805, dated Jun. 21, 2019, 8 pages.
Examination Report for European Patent Application No. 18762420.0, dated Jan. 28, 2021, 4 pages.
International Search Report and Written Opinion for International Patent Application No. PCT/US2020/057955, dated Feb. 12, 2021, 18 pages.
Examination Report for European Patent Application No. 17721889.8, dated Dec. 13, 2019, 5 pages.
International Preliminary Report on Patentability for International Patent Application No. PCT/US2018/045102, dated Feb. 13, 2020, 15 pages.
International Search Report and Written Opinion for International Patent Application No. PCT/IB2019/060455, dated Feb. 7, 2020, 17 pages.
Non-Final Office Action for U.S. Appl. No. 16/414,162, dated Dec. 23, 2019, 10 pages.
Quayle Action for U.S. Appl. No. 15/896,805, mailed Jan. 10, 2019, 5 pages.
International Search Report and Written Opinion for International Patent Application No. PCT/US2018/045102, dated Jan. 21, 2019, 23 pages.
Non-Final Office Action for U.S. Appl. No. 15/399,729, dated Mar. 27, 2019, 9 pages.
Notice of Allowance for U.S. Appl. No. 15/401,240, dated Apr. 1, 2019, 8 pages.
Non-Final Office Action for U.S. Appl. No. 16/053,980, dated Jun. 13, 2019, 7 pages.
Grant of Patent for Korean Patent Application No. 10-2018-7032540, dated May 21, 2021, 4 pages.
International Preliminary Report on Patentability for International Patent Application No. PCT/IB2019/060455, dated Jul. 1, 2021 10 pages.
Notice of Reasons for Refusal for Japanese Patent Application No. 2018-553935, dated Aug. 17, 2021, 8 pages.

* cited by examiner

ADAPTIVE AREA LAMP

FIELD OF THE DISCLOSURE

The present disclosure relates to area lamps, and in particular to adaptive solid-state area lamps including an emitter array configured to dynamically light different portions of a field of view.

BACKGROUND

A conventional area lamp includes a light source, which provides light within a field of view. In particular, the light source provides light to fill the entirety of the field of view. In some applications, it may be desirable to control the amount of light within different portions of a field of view of an area lamp. Such a scenario often occurs when the field of view associated with an area lamp encompasses a relatively large area, as illustrated in FIG. 1 wherein an area lamp 10 provides light that fills a large field of view 12. For example, if the field of view of an area lamp in a conference room encompasses both a seating area and a presentation area, it may be desirable to provide light within the seating area but not the presentation area during a presentation. As another example, lighting for stages may require highlighting some areas while de-emphasizing others, providing different levels of light to different areas of a stage and/or auditorium, or providing other lighting effects. Conventionally, this problem has been solved by replacing a single area lamp with a relatively large field of view with several area lamps with a narrower field of view, as illustrated in FIG. 2 wherein a first area lamp 10A provides light that fills a first field of view 12A and a second area lamp 10B provides light that fills a second field of view 12B, wherein the first field of view 12A corresponds with a first portion of the field of view 12 illustrated in FIG. 1 and the second field of view 12B corresponds with a second portion of the field of view 12 illustrated in FIG. 1. While such a solution increases the granularity with which illumination can be provided within a space, the larger number of area lamps increases both the cost and complexity of a lighting system. Further, such a solution may become unsightly due to the large number of area lamps required to be installed in a ceiling and may decrease the energy efficiency of the lighting system.

In light of the above, there is a need for an area lamp that is capable of controlling the illumination within different portions of a field of view.

SUMMARY

In one embodiment, an area lamp includes an emitter array and driver circuitry. The emitter array includes a number of solid-state light emitters. Each one of the solid-state light emitters is configured to provide light suitable for general illumination within a field of view such that light emitted from a first subset of the number of solid-state light emitters is provided to a different portion of the field of view than light emitted from a second subset of the number of solid-state light emitters. The driver circuitry is coupled to the emitter array and configured to provide drive signals to the emitter array such that the light provided from each one of the solid-state light emitters is independently controllable and the number of drive signals is less than the number of solid-state light emitters. Using a smaller number of drive signals than there are solid-state light emitters while maintaining independent control over each one of the solid-state light emitters significantly reduces the complexity of the area lamp.

In one embodiment, an area lamp includes an emitter array and driver circuitry. The emitter array includes a number of solid-state light emitters. Each one of the solid-state light emitters is configured to provide light suitable for general illumination within a field of view such that light from each one of the solid-state light emitters is provided to a different portion of the field of view. The driver circuitry is coupled to the emitter array and configured to provide drive signals to the emitter array such that in a first mode only a first portion of the field of view is illuminated by the emitter array and in a second mode only a second portion of the field of view, which is different from the first portion, is illuminated by the emitter array. By allowing the area lamp to selectively illuminate different portions of the field of view, the area lamp may provide additional functionality and thus replace multiple conventional area lamps.

In one embodiment, an area lamp includes an emitter array and driver circuitry. The emitter array includes a number of solid-state light emitters. Each one of the solid-state light emitters is configured to provide light suitable for general illumination within a field of view such that light from each one of the solid-state light emitters is provided to a different portion of the field of view. The driver circuitry is coupled to the emitter array and configured to provide drive signals to the emitter array to provide a pattern of illumination within the field of view. By allowing the area lamp to provide a pattern of illumination, the area lamp may provide additional functionality over conventional area lamps.

In one embodiment, an area lamp includes an emitter array and driver circuitry. The emitter array includes a number of solid-state light emitters. Each one of the solid-state light emitters is configured to provide light suitable for general illumination within a field of view such that light from each one of the solid-state light emitters is provided to a different portion of the field of view. The driver circuitry is coupled to the emitter array and configured to detect a location of a person within the field of view and provide illumination only in a subsection of the field of view surrounding the location. By detecting the location of a person within the field of view of the area lamp and providing illumination only in a subsection of the field of view surrounding the location, the area lamp may provide additional functionality over conventional area lamps.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1:
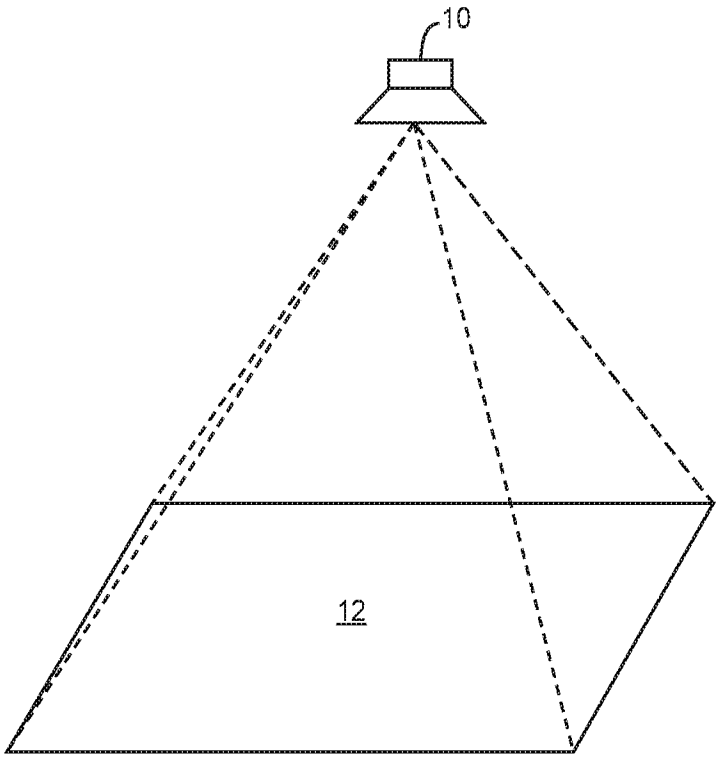
FIG. 1 (RELATED ART)
FIG. 1 illustrates a conventional area lamp and the field of view provided thereby.
Figure 2:
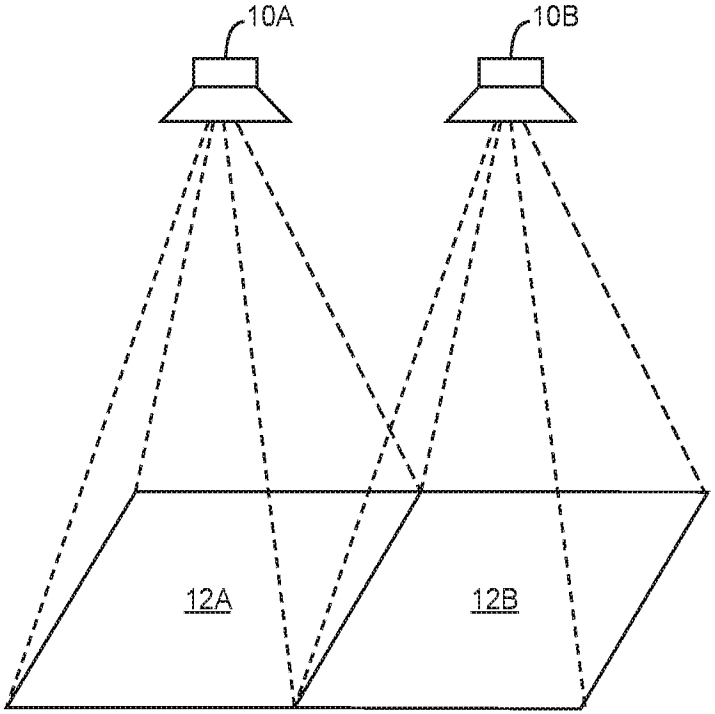
FIG. 2 (RELATED ART)
FIG. 2 illustrates a number of conventional area lamps and their corresponding fields of view.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Figure 3:
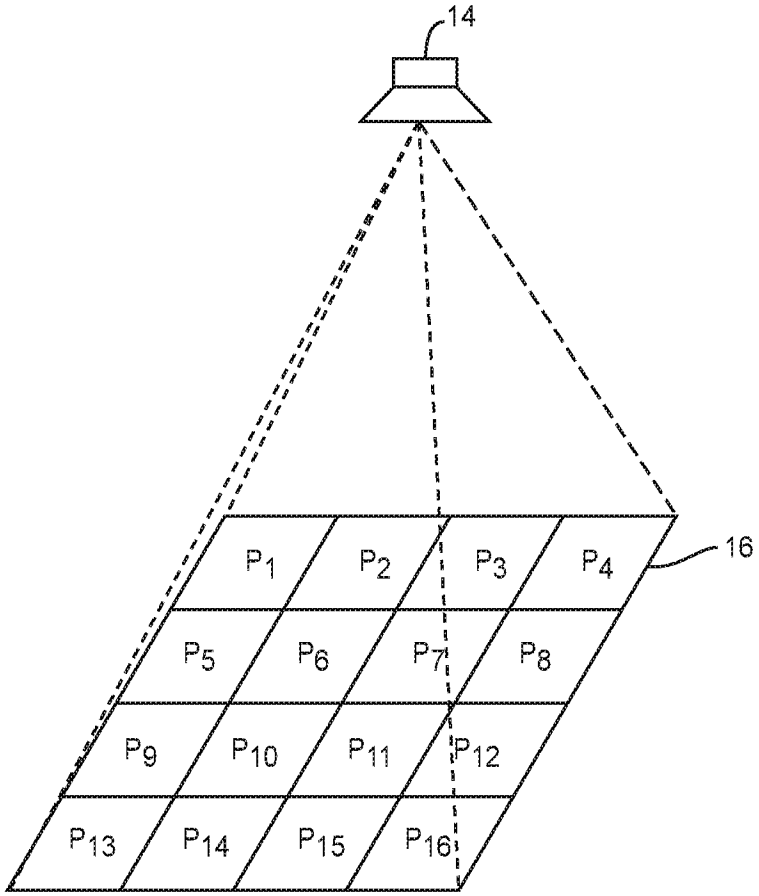
FIG. 3 illustrates an area lamp and the field of view provided thereby according to one embodiment of the present disclosure.

FIG. 3 illustrates an area lamp 14 according to one embodiment of the present disclosure. As defined herein, an area lamp is a lighting device configured to provide light for general illumination. As discussed herein, lights for general illumination are stationary lights configured to provide light within a particular indoor or outdoor space. Examples of area lamps include overhead lighting such as troffer or recessed lighting fixtures, downlights, outdoor street lamps, accent lights, stage lights, and the like. The area lamp 14 includes a light source, which is configured to illuminate a field of view 16. In particular, the light source is configured such that the area lamp 14 is capable of selectively illuminating different portions $P_1$-$P_{16}$ of the field of view 16 in a dynamic fashion. Such functionality may be enabled by an emitter array, such as an array of light emitting diodes (LEDs), which may be operated by driver circuitry as discussed in detail below. Providing an area lamp 14 that is capable of selectively illuminating different portions $P_1$-$P_{16}$ of a field of view 16 may provide several advantages over a conventional area lamp that is only capable of illuminating the entirety of a field of view as discussed in detail below.

Figure 4:
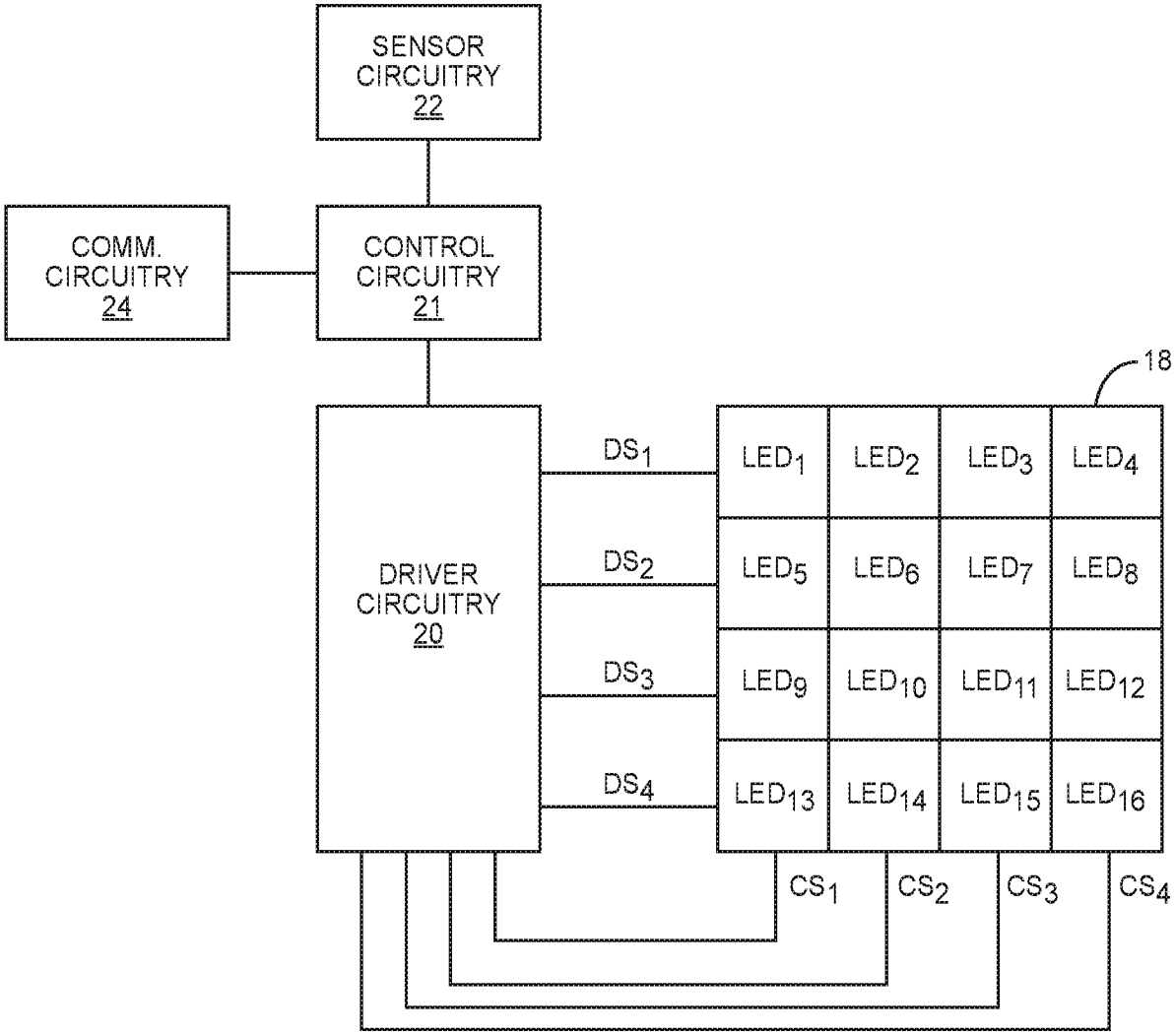
FIG. 4 illustrates details of an area lamp according to one embodiment of the present disclosure.

FIG. 4 illustrates details of the area lamp 14 according to one embodiment of the present disclosure. The area lamp 14 includes an emitter array 18, driver circuitry 20, control circuitry 21, sensor circuitry 22, and communications circuitry 24. The driver circuitry 20 is coupled to the emitter array 18. The sensor circuitry 22 and the communications circuitry 24 are coupled to the control circuitry 21, which may or may not be integrated into the driver circuitry 20. The emitter array 18 includes a number of solid-state light emitters, which in the present embodiment are LEDs (individually $LED_1$ through $LED_{16}$). In operation, the driver circuitry 20 is configured to provide one or more drive signals DS (individually $DS_1$ through $DS_4$) and/or one or more control signals CS (individually $CS_1$ through $CS_4$) to the emitter array 18. The one or more drive signals DS in combination with the one or more control signals CS provide the primary power for operation of individual LEDs in the emitter array 18. In the present embodiment, the drive signals DS and the control signals CS are provided to each one of a number of columns and/or rows in the emitter array 18 through one or more control lines coupled between the emitter array 18 and the driver circuitry 20. The driver circuitry 20 is further configured to selectively provide a path for current flow to each column in the emitter array 18. When a path for current flow is provided by the driver circuitry, current from a drive signal DS provided at one of the rows may flow from the row through the column such that the LED located at the row in which the drive signal DS is provided and the column at which the path for current flow is provided by way of a control signal CS is illuminated. In various embodiments, selectively providing a path for current flow may involve connecting the column to a fixed potential such as ground. When a path for current flow is not provided, the column may be left floating, or may be connected to a different fixed potential such that a threshold voltage across the LEDs in the column is not exceeded when a drive signal DS is provided and thus the LEDs in that column do not turn on in response to a drive signal DS provided thereto.

Figure 5:
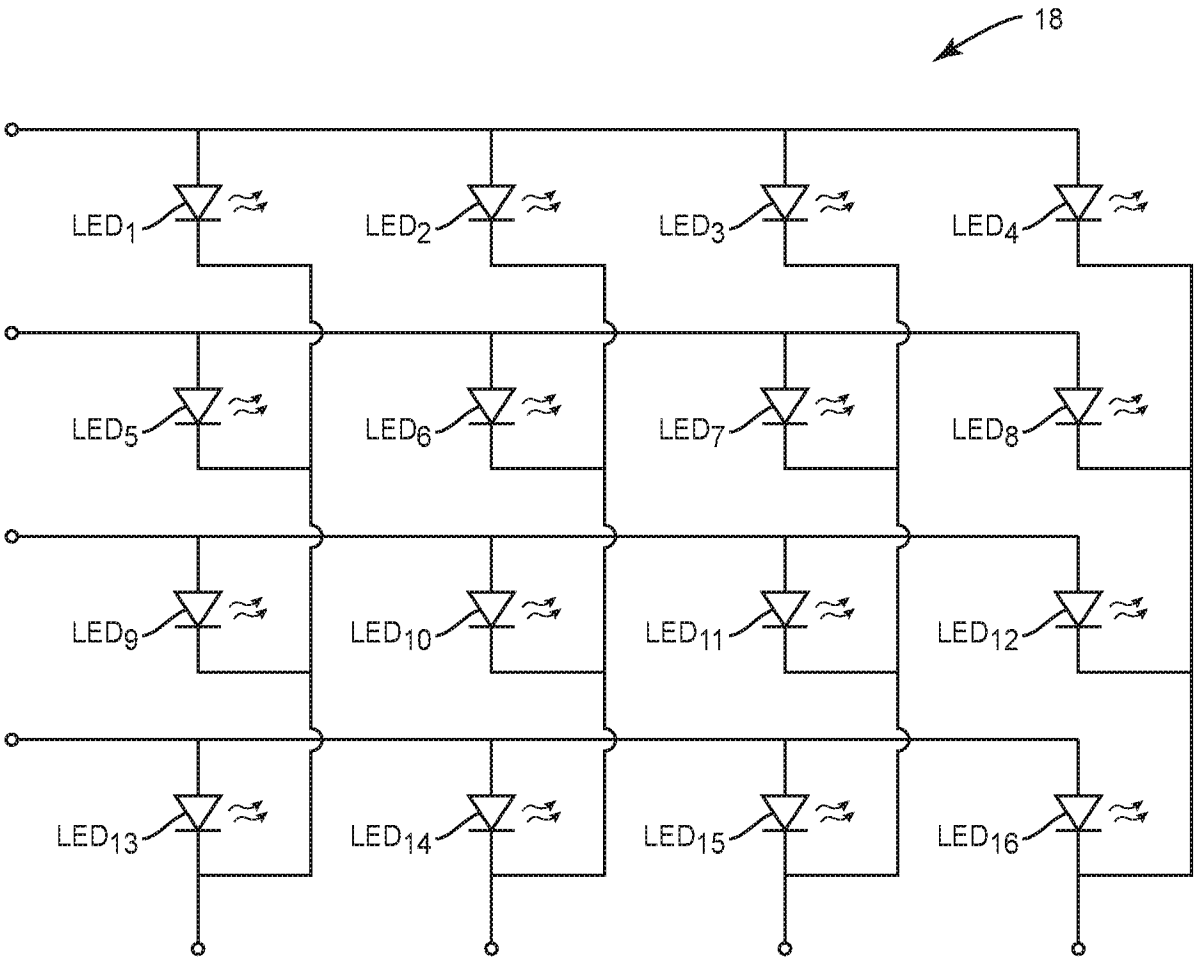
FIG. 5 illustrates details of an emitter array according to one embodiment of the present disclosure.

Details of the arrangement of the LEDs in the emitter array 18 are shown in FIG. 5. As illustrated, anodes of the LEDs in each row are coupled together, and cathodes of the LEDs in each column are coupled together. Only when a drive signal DS is provided at the row of an LED in the emitter array 18 and a path for current flow is provided at the column of the LED will the LED illuminate.

Due to the configuration of the LEDs discussed above, there are significantly less drive signals provided to the emitter array 18 than there are LEDs in the emitter array 18, which simplifies the circuitry of the area lamp 14. While only sixteen LEDs are shown in the emitter array 18 of FIG. 4 for purposes of illustration, the emitter array 18 may include any number of LEDs without departing from the principles herein. As the number of LEDs in the emitter array 18 increases, it quickly becomes impractical to provide an individual drive signal to each one of the LEDs. This is due to the fact that doing so would require an individual connection to each LED in the emitter array 18, thereby necessitating a large number of outputs from the driver circuitry 20 and highly dense signal routing paths from the driver circuitry 20 to the emitter array 18. At the same time, it is desirable to be able to individually control each one of the LEDs in the emitter array 18. Accordingly, a multiplexing scheme is used for controlling each one of the LEDs in the emitter array 18 wherein the drive signals DS provided to each row of the emitter array 18 are multiplexed in time (e.g., sequentially scanned). In synchrony with the drive signals, the driver circuitry 20 selectively provides a path for current flow to complete a circuit path through desired ones of the LEDs in the emitter array 18. As discussed above, only those LEDs receiving a drive signal DS at the row thereof and having a path for current flow at the column thereof by way of a control signal CS will be illuminated. The multiplexing of the drive signals DS and the control signals CS may be performed such that desired ones of the LEDs appear to be constantly illuminated. That is, the illumination of the individual LEDs in the emitter array 18 may occur such that the light provided therefrom does not flicker as observed by the human eye.

Figure 6:
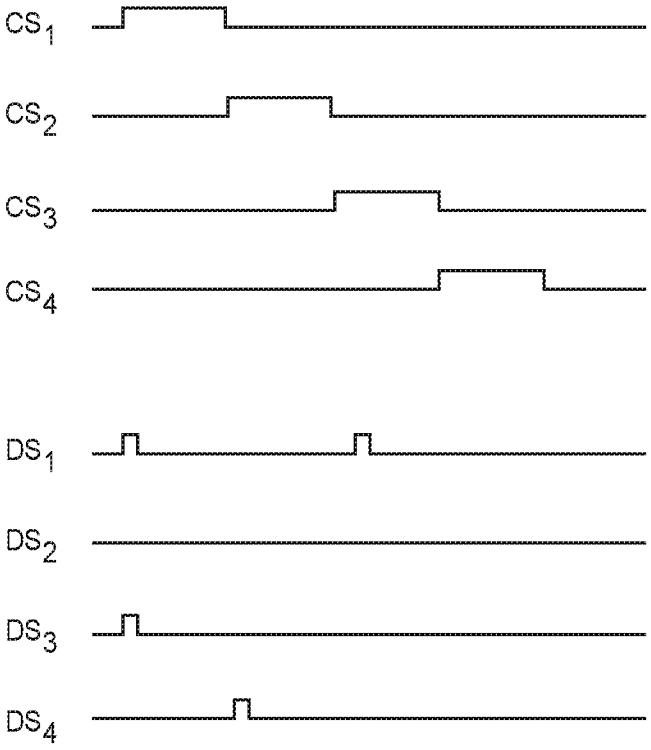
FIG. 6 is a timing diagram illustrating a control scheme for an emitter array according to one embodiment of the present disclosure.

FIG. 6 shows an exemplary multiplexing scheme for the drive signals DS and the control signals CS. As illustrated, the control signals CS may be sequentially pulsed in a repeating fashion, while the drive signals DS may be pulsed within a pulse period of a control signal CS. When both a drive signal DS and a control signal CS are high in the diagram shown in FIG. 6, a path for current flow is provided through the LED located at the column of the control signal CS and the row of the drive signal DS. Accordingly, this LED or multiple LEDs within the column are illuminated. The pulsing of the drive signals DS and the control signals CS is done at a speed such that the LEDs appear to be continuously illuminated. In other words, the drive signals DS and the control signals CS are pulsed at a speed that is imperceptible to the human eye.

The driver circuitry 20 may include the control circuitry 21, which may receive one or more measurements from the sensor circuitry 22 or other inputs (e.g., input from a user) provided via the communications circuitry 24 or otherwise. For example, the control circuitry 21 may receive measurements relating to ambient light level and occupancy from the sensor circuitry 22. The control circuitry 21 may decide which ones of the LEDs to illuminate as well as other lighting parameters such as brightness, color temperature, and the like, based on these measurements. In various embodiments, the control circuitry 21 may receive inputs from any number of different sensors and devices such as radar sensors, cameras, and the like.

The control circuitry 21 may also receive messages from remote devices such as other area lamps and/or controllers via the communications circuitry 24. In some embodiments, these messages may include input from a user. For example, a user may interact with a wall switch, a touchscreen controller, or a mobile device such as a smartphone, tablet, or computer in order to provide the messages to the control circuitry 21. A user interface may be provided to the user including an image of the area to be illuminated by the area lamp 14 or a group of lights including the area lamp 14 such that subsections of the area can be tapped and illuminated by the area lamp 14. The control circuitry 21 may similarly use data in these messages to make lighting decisions. The messages received from remote devices may include data such as sensor measurements, lighting commands, and the like. The messages may be received by the communications circuitry 24 via a wired or wireless network.

The circuitry for the area lamp 14 shown in FIGS. 4 and 5 is merely exemplary. Those skilled in the art will appreciate that functionality provided by the driver circuitry 20, the control circuitry 21, the sensor circuitry 22, the communications circuitry 24, and any other portion of the area lamp 14 may be provided by a single module or any number of different functional modules, all of which are contemplated herein. Further, those skilled in the art will appreciate that any number of different configurations for connecting the LEDs in the emitter array 18 exists for accomplishing the purposes discussed above, all of which are contemplated herein.

Operating the emitter array 18 as described above allows for the individual control over each one of the LEDs in the emitter array 18 using significantly less drive signals DS and thus connections to the emitter array 18 than the number of LEDs contained therein. Accordingly, the complexity of the area lamp 14 is reduced. In particular, the complexity of the driver circuitry 20 and the routing of connections between the driver circuitry 20 and the emitter array 18 is reduced when compared to an approach wherein each LED in the emitter array 18 has an individual connection to the driver circuitry 20.

Figure 7:
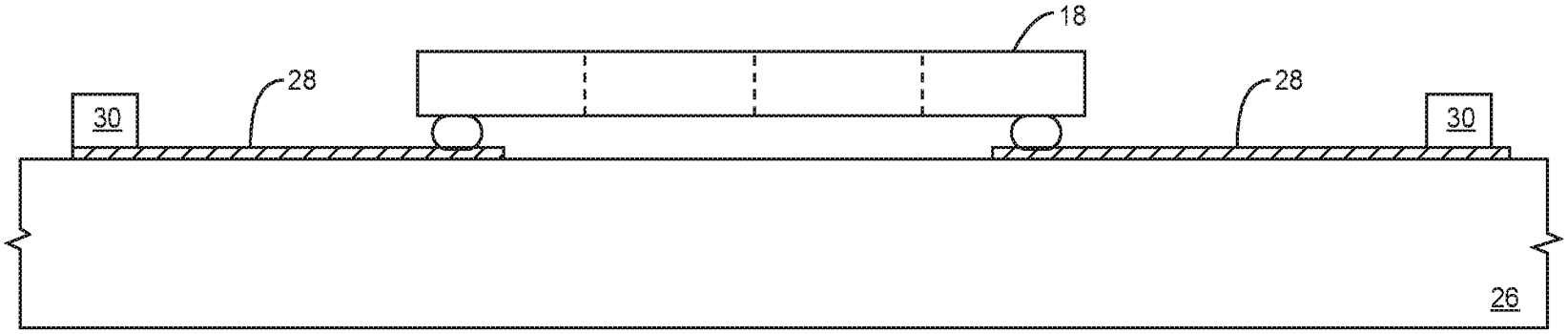
FIG. 7 illustrates details of an emitter array and a passive submount according to one embodiment of the present disclosure.

In some embodiments, the control scheme discussed above may allow for the use of a completely passive submount 26 for the emitter array 18, as illustrated in FIG. 7. The emitter array 18 may be a monolithic integrated circuit. That is, in some embodiments the LEDs of the emitter array 18 may be formed on the same semiconductor substrate. Generally, the emitter array 18 must be mounted on the submount 26 so that connections can be made to the LEDs therein. The submount 26 will generally provide a fan-out structure that allows other circuitry such as the driver circuitry 20 to connect to the LEDs in the emitter array 18 as discussed above. The operating scheme described above for the area lamp 14 may allow such a submount 26 to be free of any active components (i.e., a passive-matrix). In other words, the submount 26 on which the emitter array 18 is provided may only be used for the routing of connections, and thus may include one or more conductive traces 28 suitable for routing connections between the emitter array 18 and one or more connectors 30. The emitter array 18 may be coupled to the conductive traces 28 via any suitable technology, such as via flip-chip solder ball grid array as shown, flip-chip copper pillar, wire bond, or the like. Such a passive submount 26 may be significantly less complex than a submount requiring active components and thus may reduce the complexity and cost of the area lamp 14.

Figure 8:
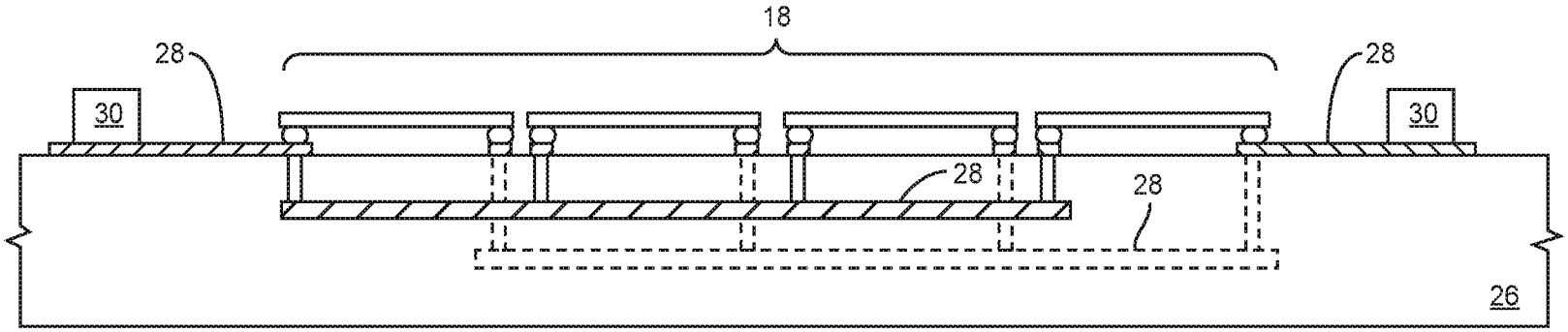
FIG. 8 illustrates details of an emitter array and a passive submount according to one embodiment of the present disclosure.

FIG. 8 illustrates the emitter array 18 according to an additional embodiment of the present disclosure wherein the LEDs are separately provided by different semiconductor die. In the embodiment shown in FIG. 7, the emitter array 18 is formed by a number of discrete LEDs mounted on the submount 26. The LEDs are connected to one another by the conductive traces 28, which are shown below a surface of the passive submount 26 (e.g., by way of a multi-layer printed circuit board). As discussed above, the operating scheme described above for the area lamp 14 may allow the submount 26 to be free of any active components, which may significantly decrease the complexity of the submount 26 and therefore the area lamp 14.

Further to the above, the control scheme discussed above may allow the emitter array 18 to be controlled using one or more off-the-shelf components for the driver circuitry 20, such as part number MBI5026 manufactured by Macroblock of Hsinchu, Taiwan or other similar display driver parts. To compensate for the fact that these parts are used to drive LEDs for displays, which provide significantly less light than LEDs used for general illumination such as the LEDs in the emitter array 18 and thus are operated at lower power, these off-the-shelf components may be adjusted to provide the drive signals DS at their maximum rated current output, may be overdriven above their maximum rated current output, or multiple off-the-shelf components may be connected in parallel to provide additional current for the drive signals DS. For example, the driver circuitry 20 may be configured to provide the driver signals DS such that the instantaneous current density of each one of the LEDs in the emitter array is greater than 5 $A/mm^2$, greater than 10 $A/mm^2$, greater than 50 $A/mm^2$, and even greater than 100 $A/mm^2$ when illuminated.

Figure 9:
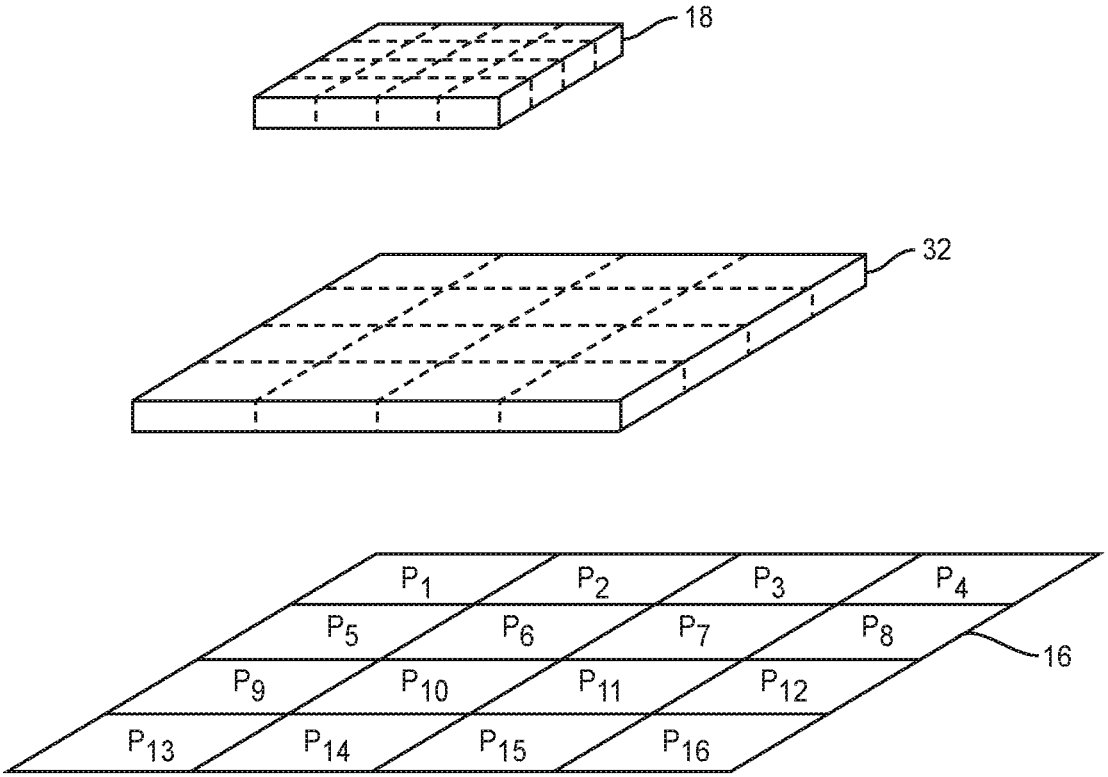
FIG. 9 illustrates details of an emitter array and corresponding lens(es) according to one embodiment of the present disclosure.

In order to enable the LEDs in the emitter array 18 to selectively illuminate different portions of the field of view 16, one or more optic elements 32 (e.g., lenses) may be provided in the area lamp 14, as illustrated in FIG. 9. The one or more optic elements 32 may be responsible for focusing or otherwise conditioning light from one or more of the LEDs in the emitter array 18 such that the light provided by the one or more of the LEDs is substantially confined to a portion P of the field of view 16. The one or more optic elements 32 may be provided in any number of configurations suitable for providing such functionality. In one embodiment, the one or more optic elements 32 may be provided as a single lens. In another embodiment, the one or more optic elements 32 may comprise a single lens having multiple lens segments. In yet another embodiment, the one or more optic elements 32 may include any number of separate or connected lens elements. Further, the optical elements 32 may include primary and/or secondary optics that work together to focus or otherwise condition the light provided by the one or more LEDs as discussed above. While the emitter array 18 and the optic elements 32 are shown as flat, rectangular components in FIG. 8, the present disclosure is not so limited. The emitter array 18 and the optic elements 32 may be provided in any number of shapes, for example, as curved or otherwise non-planar elements, in order to provide the functionality discussed herein. Providing the emitter array 18 and the one or more optic elements 32 in this manner allows the area lamp 14 to selectively illuminate different portions of the field of view 16. In one embodiment, each LED in the emitter array 18 is configured to illuminate a different portion P of the field of view 16. That is, in one embodiment there is a one to one relationship between the LEDs in the emitter array 18 and the number of portions within the field of view of the area lamp 14 that may be selectively illuminated. In another embodiment, different groups of LEDs in the emitter array 18 are configured to illuminate different portions P of the field of view 16. That is, in one embodiment there is a many to one relationship between the LEDs in the emitter array 18 and the number of portions within the field of view of the area lamp 14 that may be selectively illuminated. The number of LEDs in the emitter array 18 and the configuration of the one or more optic elements 32 will generally dictate the number of different portions P of the field of view 16 that can be selectively illuminated. However, the relationship between the number of LEDs in the emitter array 18 and the number of different portions P of the field of view 16 may not be one-to-one, but rather may be many-to-one, one-to-many, or any combination thereof.

Providing the area lamp 14 such that it is capable of selectively illuminating different portions P of the field of view 16 may be used to provide additional features over conventional area lamps. First, multiple area lamps 14 having a relatively narrow field of view may be replaced by a single area lamp 14 according to the present disclosure, thereby simplifying a lighting system in which the area lamp 14 is provided. In applications in which area lamps 14 already provide a relatively large field of view (e.g., factory lighting, outdoor lighting), additional functionality may be provided by allowing for the selective illumination of different portions of the field of view thereof.

Figure 10:
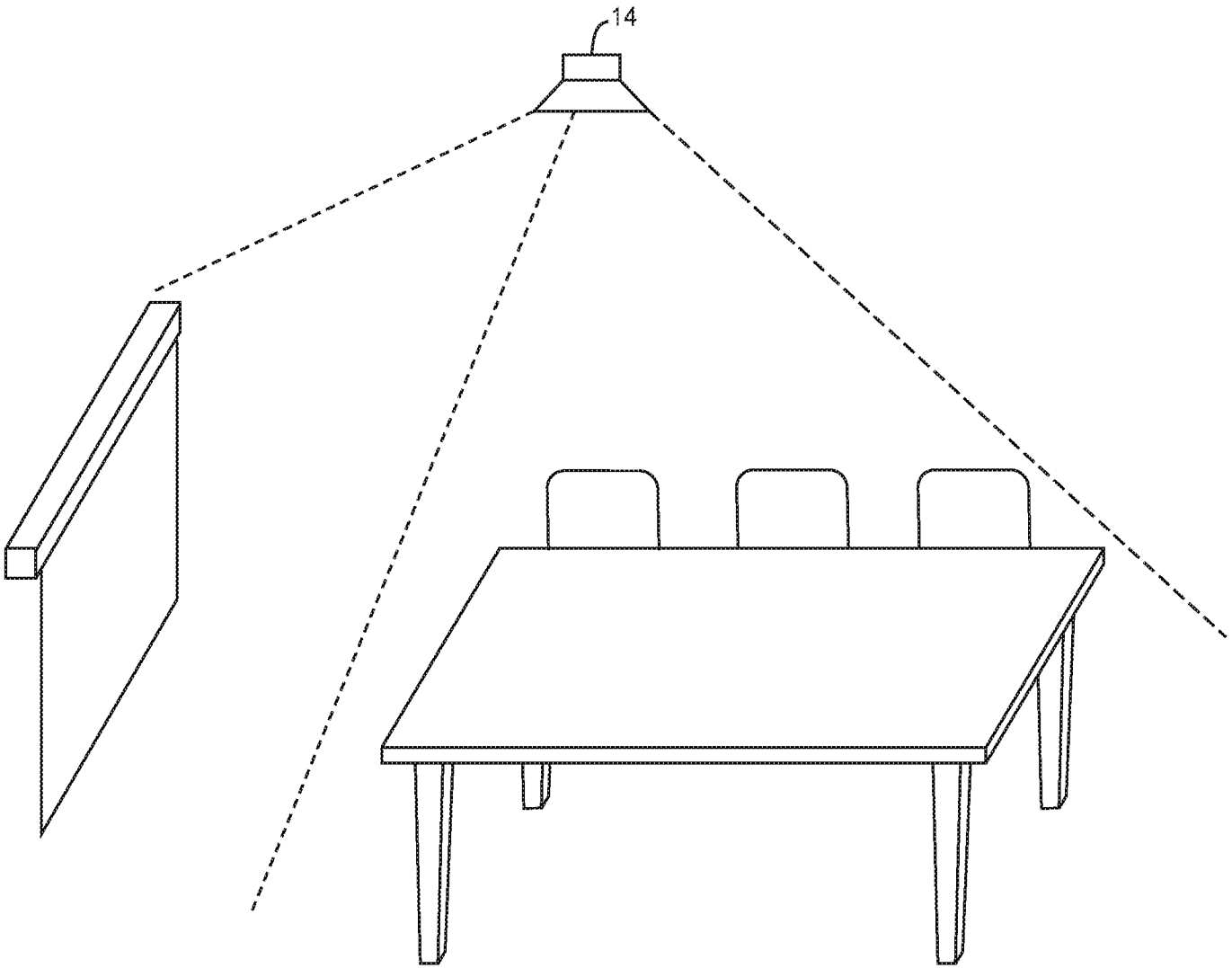
FIG. 10 illustrates an exemplary lighting application of an area lamp according to one embodiment of the present disclosure.

In one exemplary embodiment, the control circuitry 21 may be configured to illuminate a first portion of the field of view of the area lamp 14 in a first mode of operation, and illuminate a second portion of the field of view of the area lamp 14 in a second mode of operation. The first portion may include the entirety of the field of view, while the second portion may include a subset of the field of view. Such an application may be useful, for example, in an area lamp 14 provided in a conference room in which the field of view of the area lamp overlaps a seating area and a presentation area as illustrated in FIG. 10. During a presentation in the conference room, it may be undesirable to directly light the presentation area, for example, to avoid washing out images presented on a screen in the presentation area. Accordingly, the first mode of operation of the area lamp 14 may be used when a presentation is not being given in the conference room while the second mode of operation may be used when a presentation utilizing the screen is in progress in the conference room. The control circuitry 21 may interact with the sensor circuitry 22, which may include an image sensor such as a camera, in order to light dark areas more than light areas in some embodiments. In these embodiments, when the projector is turned on the light provided by the area lamp 14 in that area would automatically be reduced due to the additional brightness provided by the projector. Accordingly, such a transition may happen automatically. In other embodiments, this function may be initiated by a user (e.g., by interaction with a wall switch, a touchscreen interface, or a smartphone, tablet, or computer). Such applications may further be used to reduce the power consumption of the area lamp 14, for example, in a setting in which only a portion of the field of view is required to be illuminated. If only half of the LEDs in the emitter array 18 are required for illuminating the portion of the field of view as opposed to the entirety thereof, the power consumption of the area lamp 14 may be reduced when illumination of the entirety of the field of view is not required. For example, if nobody is in the presentation area of the conference room the area lamp 14 may not illuminate the presentation area to reduce the power consumption thereof in certain embodiments.

Figure 11:
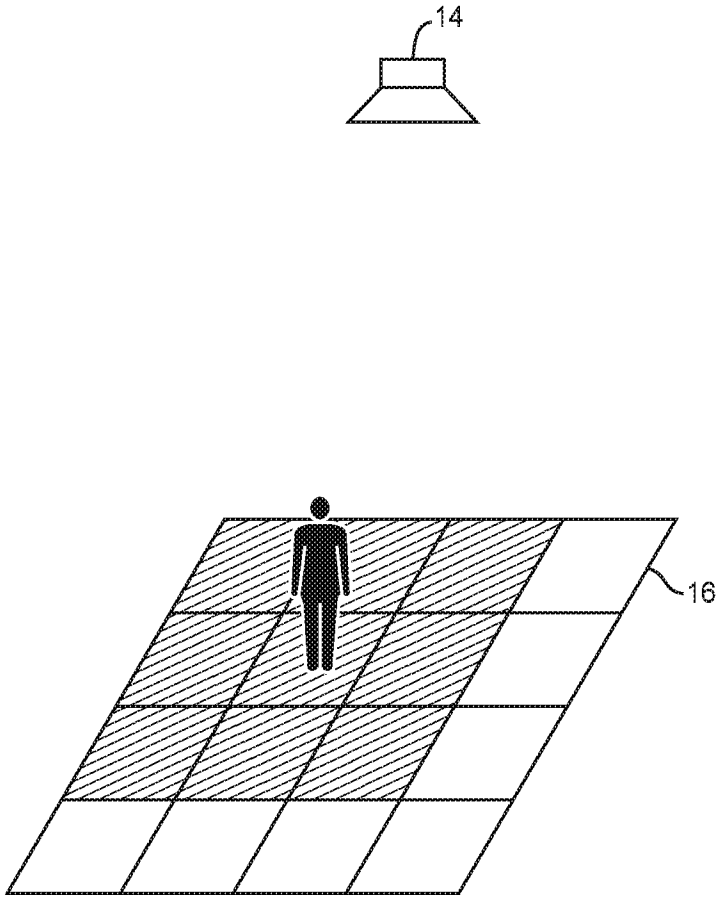
FIG. 11 illustrates an exemplary lighting application of an area lamp according to one embodiment of the present disclosure.
Figure 12:
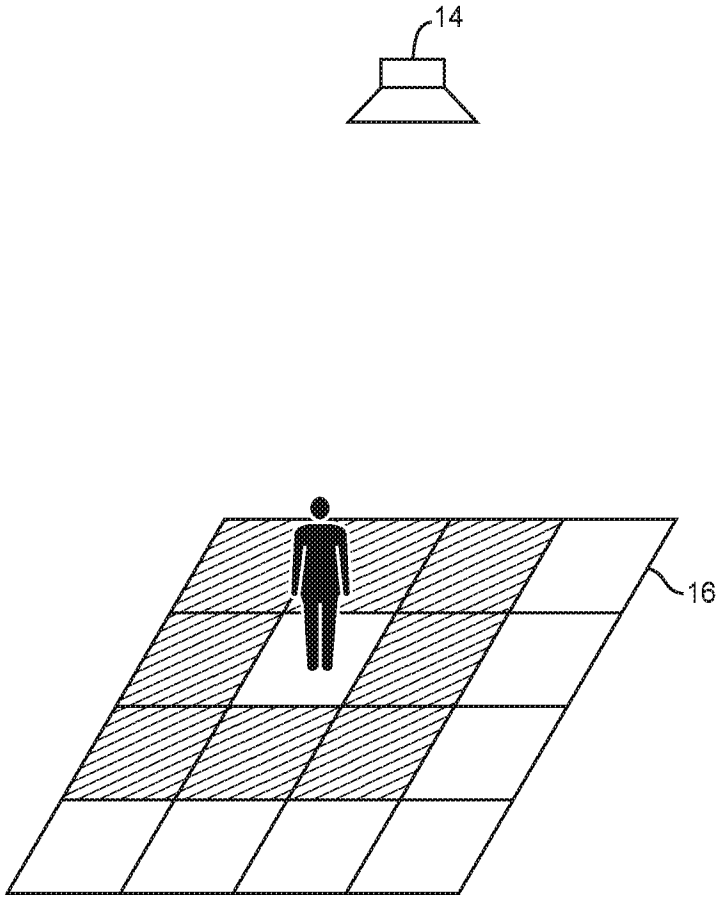
FIG. 12 illustrates an exemplary lighting application of an area lamp according to one embodiment of the present disclosure.

In another embodiment, the control circuitry 21 may be configured to use measurements from the sensor circuitry 22 to locate one or more objects within the field of view of the area lamp 14. The control circuitry 21 may then illuminate a subsection of the field of view of the area lamp 14 surrounding the object or objects. In other embodiments, it may be desirable to illuminate the area surrounding an object or objects but not the area directly in which the object or objects is located in order to avoid glare or otherwise disturbing the object or objects. Accordingly, a ring of illumination may be provided around the object or objects in some embodiments such that illumination is not provided directly over the object or objects. The object or objects may include, for example, a person, a vehicle, and/or an animal. FIG. 11 illustrates an embodiment wherein a number of portions surrounding a person in the field of view of the area lamp 14 are illuminated as indicated by the hatched lines in these portions. FIG. 12 illustrates an embodiment wherein a number of portions surrounding a person in the field of view but not the portion of the field of view in which the person is standing are illuminated as indicated by the hatched lines in these portions.

Figure 13:
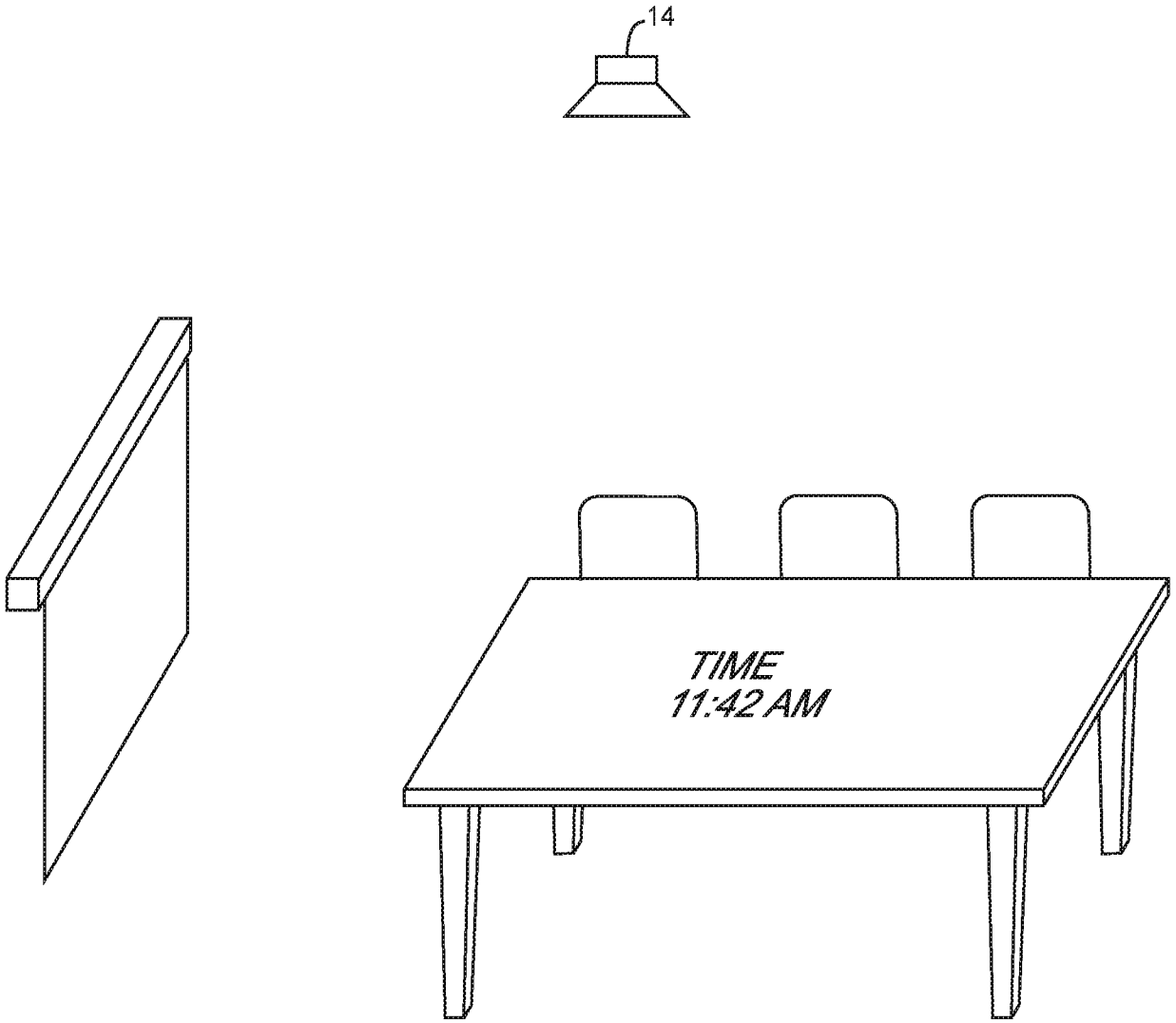
FIG. 13 illustrates an exemplary lighting application of an area lamp according to one embodiment of the present disclosure.

In another embodiment, the driver circuitry 20 may be configured to provide a pattern of illumination within the field of view of the area lamp 14. Such patterns may be dynamic and used to communicate information to a person or persons viewing the illumination pattern. For example, if a large enough number of LEDs in the emitter array 18 are provided and the one or more optic elements 32 divide the field of view into a relatively large number of portions with adequate resolution, alphanumeric characters may be selectively illuminated or not illuminated within the field of view of the area lamp 14 such that readable information can be conveyed thereby. For example, the time of day, the number of parking spots remaining in a parking garage, the weather outside, or any other information may be projected onto a surface within the field of view of the area lamp 14, effectively turning any surface within the field of view into an informational display. The information presented within the field of view is only limited by the resolution achievable by the emitter array 18 and the one or more optic elements 32 as discussed above, as well as the suitability of the surfaces for the display of information within the field of view of the area lamp 14. In various embodiments, distortions such as those due to orientation, surface shape, and the like of various surfaces in the field of view may be detected by the sensor circuitry 22, for example, using a camera or a depth-sensing camera, and corrected or otherwise compensated for by the one or more optic elements 32, which may be dynamically controlled by the driver circuitry 20. FIG. 13 illustrates an embodiment wherein the time of day is projected onto a table in a conference room by the area lamp 14. In such an embodiment, the area lamp 14 may include a large number of LEDs in the emitter array 18 and precise optics in the one or more optic elements 32 allowing the area lamp to project the time onto the table with a desired degree of precision. In the exemplary illustration of FIG. 13, the time may be displayed by not providing light in this area; however, the opposite may also be true in various embodiments. Further, the emitter array 18 may include LEDs having different colors in various embodiments such that information may be displayed using a different color of light than that used for general illumination.

Figure 14:
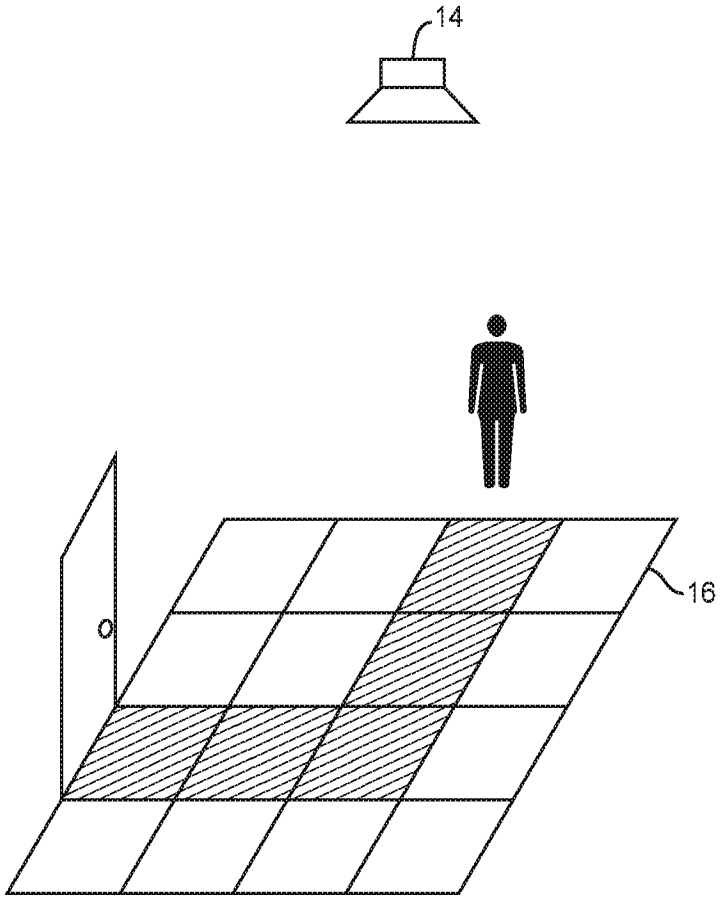
FIG. 14 illustrates an exemplary lighting application of an area lamp according to one embodiment of the present disclosure.

In another example, a desired path for traffic (e.g., foot traffic, vehicle traffic, etc.) may be illuminated through the field of view, indicating the path that should be taken by a person or persons traveling through the field of view. Such an application may be especially useful in emergency situations in which a path to the closest exit may be illuminated by the area lamp 14. Further, such an application may be useful for providing directions through a space, such as directing a vehicle into a vacant parking spot in a parking garage or directing an individual towards a reception area in a building. FIG. 14 illustrates an embodiment in which a path through the field of view 16 of the area lamp 14 to a nearby door is illuminated such that a person can follow the illuminated path and reach the door.

In various embodiments, several area lamps 14 may work together to provide light to different portions of a combined area of interest. The field of view of each one of the area lamps 14 may overlap to some extent. Accordingly, adjacent ones of the area lamps 14 may be configured to coordinate the light output thereof to selectively provide light to different portions of the overlapping fields of view thereof. Image sensors within or otherwise connected to the area lamps 14 may be used to coordinate these adjacent area lamps 14. For example, an image sensor associated with a first area lamp 14 may detect a light pattern provided by an adjacent area lamp 14 and coordinate with the adjacent area lamp in order to contribute to or not interfere with the light pattern provided thereby.

Those skilled in the art will recognize improvements and modifications to the preferred embodiments of the present disclosure. All such improvements and modifications are considered within the scope of the concepts disclosed herein and the claims that follow.

What is claimed is:

1. A stationary area lamp for general illumination of multiple areas of an indoor or outdoor space, the stationary area lamp comprising:

an emitter array comprising a plurality of solid-state light emitters, wherein each one of the plurality of solid-state light emitters is configured to provide light suitable for general illumination within a field of view such that light emitted from a first subset of the plurality of solid-state light emitters is provided to a first area of the multiple areas corresponding to a first portion of the field of view, and light emitted from a second subset of the plurality of solid-state light emitters is provided to a second area of the multiple areas corresponding to a second portion of the field of view, wherein the first area differs from the second area; and driver circuitry coupled to the emitter array and configured to provide a plurality of drive signals to the emitter array, the drive signals providing primary power for operation of solid-state light emitters of the plurality of solid-state light emitters, such that the light provided from each one of the plurality of solid-state light emitters is independently controllable and a number of drive signals in the plurality of drive signals is less than a number of solid-state light emitters in the plurality of solid-state light emitters.

2. The stationary area lamp of claim 1 wherein:

the plurality of solid-state light emitters are arranged in a grid comprising a plurality of rows and a plurality of columns; and the driver circuitry is configured to:

provide a drive signal to each one of the plurality of rows; and selectively provide a path for current flow through each one of the plurality of columns such that when the path for current flow is provided the drive signal may flow through the solid-state light emitters in the column.

3. The stationary area lamp of claim 2 wherein the driver circuitry is configured to multiplex the drive signals provided to each one of the plurality of rows and each one of the plurality of columns in order to selectively provide the paths for current flow such that each one of the plurality of solid-state light emitters is independently controllable.

4. The stationary area lamp of claim 3 wherein the driver circuitry is configured to multiplex the plurality of drive signals and a plurality of control signals provided to the plurality of solid-state light emitters in time.

5. The stationary area lamp of claim 1 wherein each one of the plurality of solid-state light emitters in the emitter array is configured to provide light to a different portion of the field of view.

6. The stationary area lamp of claim 1 further comprising one or more optical elements configured to transmit the light emitted from each one of the plurality of solid-state light emitters such that light from each one of the plurality of solid-state light emitters is provided to a different portion of the field of view.

7. The stationary area lamp of claim 6 wherein the one or more optical elements include one or more lenses.

8. The stationary area lamp of claim 1 wherein the emitter array is a monolithic integrated circuit.

9. The stationary area lamp of claim 1 wherein solid-state light emitters of the plurality of solid-state light emitters are arranged in a grid comprising a plurality of rows and a plurality of columns such that anodes of solid-state light emitters that are in each row of the plurality of rows are coupled to one another, and cathodes of solid-state light emitters that are in each column of the plurality of columns are coupled to one another.

10. A stationary area lamp for general illumination of multiple areas of an indoor or outdoor space, the stationary area lamp comprising:

an emitter array comprising a plurality of solid-state light emitters, wherein each one of the plurality of solid-state light emitters is configured to provide light suitable for general illumination within a field of view such that the light from each one of the plurality of solid-state light emitters is provided to a first area of the multiple areas corresponding to a first portion of the field of view, and light emitted from a second subset of the plurality of solid-state light emitters is provided to a second area of the multiple areas corresponding to a second portion of the field of view, wherein the first area differs from the second area; and driver circuitry coupled to the emitter array and configured to provide a plurality of drive signals to the emitter array, the drive signals providing primary power for operation of solid-state light emitters of the plurality of solid-state light emitters, such that:

a number of drive signals in the plurality of drive signals is less than a number of solid-state light emitters in the plurality of solid-state light emitters;

in a first mode, only the first area is illuminated by the emitter array; and in a second mode, only the second area is illuminated by the emitter array.

11. The stationary area lamp of claim 10 further comprising one or more optical elements configured to transmit light emitted from the emitter array such that the light from each one of the plurality of solid-state light emitters is provided to the different portions of the field of view.

12. The stationary area lamp of claim 10 wherein the emitter array is a monolithic integrated circuit.

13. The stationary area lamp of claim 10 wherein:

the driver circuitry is further configured to multiplex the plurality of drive signals such that each one of the plurality of solid-state light emitters is independently controllable.

14. A stationary area lamp for general illumination of multiple areas of an indoor or outdoor space, the stationary area lamp comprising:

an emitter array comprising a plurality of solid-state light emitters, wherein each one of the plurality of solid-state light emitters is configured to provide light suitable for general illumination towards a field of view such that the light from each one of the plurality of solid-state light emitters is provided to a first area of the multiple areas corresponding to a first portion of the field of view, and light emitted from a second subset of the plurality of solid-state light emitters is provided to a second area of the multiple areas corresponding to a second portion of the field of view, wherein the first area differs from the second area; and driver circuitry coupled to the emitter array and configured to provide a plurality of drive signals to the emitter array to provide a pattern of illumination within the field of view, the drive signals providing primary power for operation of individual solid-state light emitters of the plurality of solid-state light emitters, such that a number of drive signals in the plurality of drive signals is less than a number of solid-state light emitters in the plurality of solid-state light emitters.

15. The stationary area lamp of claim 14 wherein the pattern of illumination corresponds with one or more alphanumeric characters.

16. The stationary area lamp of claim 14 wherein the pattern of illumination indicates a desired path for movement through the field of view.

17. The stationary area lamp of claim 14 further comprising one or more optical elements configured to transmit light emitted from each one of the plurality of solid-state light emitters such that the light from each one of the plurality of solid-state light emitters is provided to the different portions of the field of view.

18. The stationary area lamp of claim 14 wherein the emitter array is a monolithic integrated circuit.

19. The stationary area lamp of claim 14 wherein:

the driver circuitry is further configured to multiplex the plurality of drive signals such that each one of the plurality of solid-state light emitters is independently controllable.

20. A stationary area lamp for general illumination of multiple areas of an indoor or outdoor space, the stationary area lamp comprising:

an emitter array comprising a plurality of solid-state light emitters, wherein each one of the plurality of solid-state light emitters is configured to provide light suitable for general illumination towards a field of view such that the light from each one of the plurality of solid-state light emitters is provided to a first area of the multiple areas corresponding to a first portion of the field of view, and light emitted from a second subset of the plurality of solid-state light emitters is provided to a second area of the multiple areas corresponding to a second portion of the field of view, wherein the first area differs from the second area; and driver circuitry coupled to the emitter array and configured to detect a location of a target object within the field of view and provide illumination only in a subsection of the field of view determined by the location of the target object, the driver circuitry being configured to provide a number of drive signals that is less than a number of solid-state light emitters in the plurality of solid-state light emitters, wherein the drive signals provide primary power for operation of solid-state light emitters of the plurality of solid-state light emitters.

21. The stationary area lamp of claim 20 further comprising one or more optical elements configured to transmit the light emitted from each one of the plurality of solid-state light emitters such that the light from each one of the plurality of solid-state light emitters is provided to the different portions of the field of view.

22. The stationary area lamp of claim 20 wherein the emitter array is a monolithic integrated circuit.

23. A stationary area lamp for general illumination of multiple areas of an indoor or outdoor space, the stationary area lamp comprising:

an emitter array comprising a plurality of solid-state light emitters, wherein each one of the plurality of solid-state light emitters is configured to provide light suitable for general illumination towards a field of view such that the light from each one of the plurality of solid-state light emitters is provided to a first area of the multiple areas corresponding to a first portion of the field of view, and light emitted from a second subset of the plurality of solid-state light emitters is provided to a second area of the multiple areas corresponding to a second portion of the field of view, wherein the first area differs from the second area; and driver circuitry coupled to the emitter array and configured to provide a plurality of drive signals to the emitter array, the drive signals providing primary power for operation of solid-state light emitters of the plurality of solid-state light emitters, such that the light provided from each one of the plurality of solid-state light emitters is independently controllable and a number of drive signals in the plurality of drive signals is less than a number of solid-state light emitters in the plurality of solid-state light emitters, wherein the driver circuitry comprises a plurality of driver elements, each of which provides a portion of each one of the plurality of drive signals.

24. The stationary area lamp of claim 23 wherein the plurality of driver elements are coupled in parallel.

25. A stationary area lamp for general illumination of multiple areas of an indoor or outdoor space, the stationary area lamp comprising:

an emitter array comprising a plurality of solid-state light emitters, wherein each one of the plurality of solid-state light emitters is configured to provide light suitable for general illumination towards a field of view such that the light from each one of the plurality of solid-state light emitters is provided to a first area of the multiple areas corresponding to a first portion of the field of view, and light emitted from a second subset of the plurality of solid-state light emitters is provided to a second area of the multiple areas corresponding to a second portion of the field of view, wherein the first area differs from the second area; and driver circuitry coupled to the emitter array and configured to provide a plurality of drive signals to the emitter array, the drive signals providing primary power for operation of solid-state light emitters of the plurality of solid-state light emitters, such that the light provided from each one of the plurality of solid-state light emitters is independently controllable, wherein the plurality of drive signals are configured to drive each one of the plurality of solid-state light emitters in the emitter array such that a current density through each solid-state light emitter is greater than 5 $A/mm^2$ when illuminated.

26. The stationary area lamp of claim 25 wherein the driver circuitry is configured to drive each one of the plurality of solid-state light emitters such that a current density through each solid-state light emitter is less than 110 $A/mm^2$ when illuminated.

* * * * *